United States Patent [19]

Lee

[11] Patent Number: 4,949,935

[45] Date of Patent: Aug. 21, 1990

[54] APPARATUS FOR POSITIONING AND SUPPORTING AN INNER MOLD PANEL OF A FORM

[76] Inventor: Yuan-Ho Lee, No. 851, Chung-San Rd., Nan-Pao Tsun, Kuei-Jen Hsian, Tainan Hsieng, Taiwan

[21] Appl. No.: 369,869

[22] Filed: Jun. 22, 1989

[51] Int. Cl.[5] ..... E04G 17/14

[52] U.S. Cl. ..... 249/210; 249/33; 249/219.1; 254/100; 269/53

[58] Field of Search ..... 249/1, 3–5, 249/13, 18, 19, 20, 22, 27, 33, 34, 177, 189, 207, 208, 210, 219.1; 269/53, 54, 54.4; 254/98, 100

[56] References Cited

U.S. PATENT DOCUMENTS

| | | | |
|---|---|---|---|
| 3,300,943 | 1/1967 | Owens | 249/19 |
| 3,428,287 | 2/1969 | Redding et al. | 249/13 |
| 3,558,095 | 1/1971 | McNiel | 249/13 |
| 3,797,800 | 3/1974 | Loy | 249/13 |
| 3,815,861 | 6/1974 | Maier | 249/19 |
| 4,052,031 | 10/1977 | Melfi | 249/34 |

FOREIGN PATENT DOCUMENTS

| | | | |
|---|---|---|---|
| 3442156 | 5/1986 | Fed. Rep. of Germany | 249/18 |

*Primary Examiner*—James C. Housel
*Attorney, Agent, or Firm*—Ladas & Parry

[57] ABSTRACT

An apparatus for supporting an inner mold panel of a steel form during the process of setting up the steel-form mold panels to form a wall. The supporting apparatus includes a plurality of supporting members provided on the floor on which the inner steel-form mold panels are placed, and a plurality of jack devices each resting against one of the supporting members and pressing against the inner steel-form mold panel. The supporting member preferably has a rectangular body with a plurality of holding pins which may be embedded in the floor. The supporting member may also have a plurality of protrusions formed thereon with screws passing through a screw bore that is formed in each protrusion thereof. With the supporting apparatus of the invention, the inner steel-form mold panels will not be deformed during the process of pouring the concrete. It will therefore not be necessary to provide spacers between the inner and outer steel-form mold panels nor will it be necessary to drill holes in the surfaces of the steel-form mold panels.

6 Claims, 4 Drawing Sheets

APPARATUS FOR POSITIONING AND SUPPORTING AN INNER MOLD PANEL OF A FORM

BACKGROUND OF THE INVENTION

The present invention relates to an apparatus for positioning and supporting an inner mold panel of a steel concrete wall building form, more particularly to an apparatus for positioning and supporting an inner mold panel of a steel concrete wall building forms during the set up thereof.

Collapsible steel-form mold panels were developed by the same inventor of this invention and disclosed in U.S. Pat. Nos. 4,667,923 and 4,679,762. Steel-form mold panels can be used repeatedly and can save a great amount of construction time. Although there are many advantages associated with the use of these mold panels, it is still necessary to make further improvements thereon in order to satisfy the specific needs of the user thereof.

Referring to FIG. 1, which corresponds to FIG. 11 of abovementioned U.S. Pat. No. 4,679,762, a sectional view of the steel-form mold panels already set up and ready for concrete pouring is shown. In the set up process of the steel-form mold panels, inner mold panels 10 are first installed and outer mold panels 12 are then pulled up to be associated with said inner mold panels by means of a plurality of suspension devices 11 and spacers (13 or 14) at their upper portions and lower portions thereof respectively. It should be notes that holes must be drilled on both the inner and outer mold panels in order to install the spacers (13 or 14). After all of the steel-form mold panels are set up, walls 15 and a floor 17 can be constructed by means of one concrete pouring process.

The advantages of the above described method of constructing a building are readily apparent. By using this method set-up of the steel-form mold panels is quite easy, the walls and floor of a building can be constructed simultaneously, less time is required for the set-up and detachment of the steel-form mold panels, etc. However, regarding the actual application of the above steel-form mold panels, it has been discovered that there is still much room for improvement.

(1) During the concrete pouring process, the lower portions of the inner mold panels of the steel forms must withstand an extremely large expansion pressure. If no proper spacers are equipped, the maximum movement of the inner mold panels during the pouring process will be 5 cm., resulting in the formation of a curved or uneven wall surface instead of a straight or even one.

(2) As shown in the example of FIG. 1, the lower portions of the outer mold panels of the steel forms 12 rest against the walls 18 of the lower story of a building. Although a plurality of spacers are equipped between the inner and outer steel-form mold panels 10, 12, the poured concrete confined therebetween will usually exert uneven pressure onto the respective inner and outer steel-form mold panels causing these panels to move slightly. This movement of the inner and outer steel-form mold panels causes damage to the walls 18.

(3) In order to maintain a definite spacing between the inner and outer steel-form mold panels 10, 12, many spacers in the form of those shown in FIG. 1 are installed between the inner and outer steel-form mold panels. It is necessary to drill a plurality of holes on the surface of both the inner and outer steel-form mold panels. The drilling of these holes is the most time-consuming step of the whole process of setting up the steel-form mold panels. In addition, the holes left on the surface of the steel-form mold panels will decrease the effectiveness of those very valuable mold panels.

SUMMARY OF THE INVENTION

It is therefore the main object of the present invention to provide a supporting apparatus for the inner steel-form mold panels to prevent the same from any possible deformations. The apparatus can be easily manipulated to maintain a definite spacing between the inner and outer steel-form mold panels. Consequently, with the application of the apparatus of the present invention, it is no longer necessary to drill holes on the surface of the steel-form mold panels.

Another object of the present invention is to provide a supporting apparatus to press the inner mold panels into place without causing any damage to the walls of the lower story of a building.

Accordingly, the apparatus for supporting the inner steel-form mold panels comprises a supporting block formed on the floor of the lower story of a building and a jack means provided with one end thereof resting on said supporting block and another end thereof against the inner steel-form mold panel. The supporting block can either be integrally formed on the floor or be equipped with holding pins to be embedded in the floor, said holding pins being detachable so that they may be conveniently re-used.

BRIEF DESCRIPTION OF THE DRAWINGS

These and other advantages, objects and features of the present invention will become apparent from the following detailed description of the preferred embodiments with reference to the accompanying drawings.

DETAILED DESCRIPTION OF THE PREFERRED EMBODIMENTS

Figure 1:
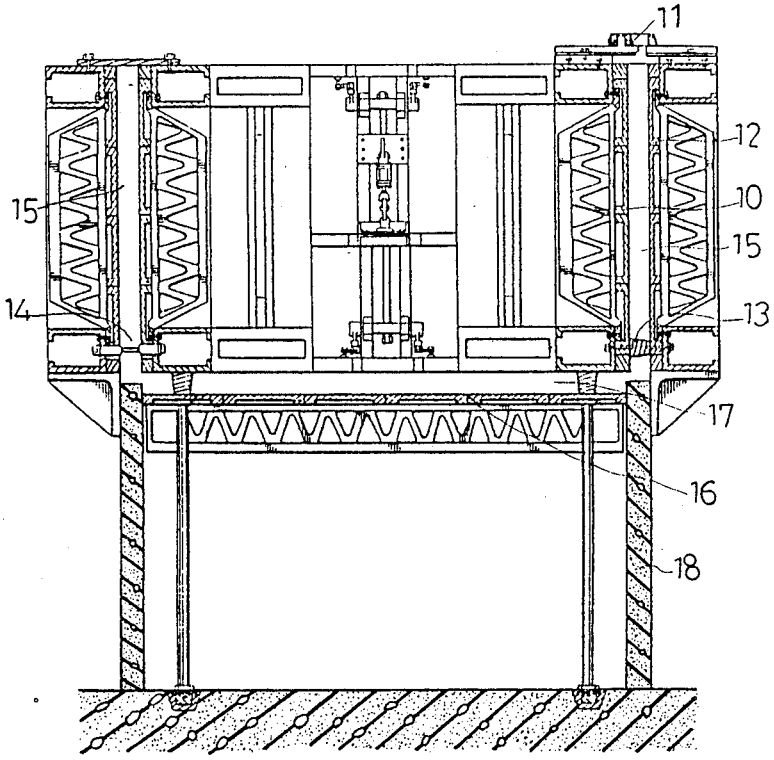
FIG. 1 (PRIOR ART)
FIG. 1 is a sectional view of the setup of the steel-form mold panels illustrating the connection between the inner and outer steel-form mold panels.
Figure 2:
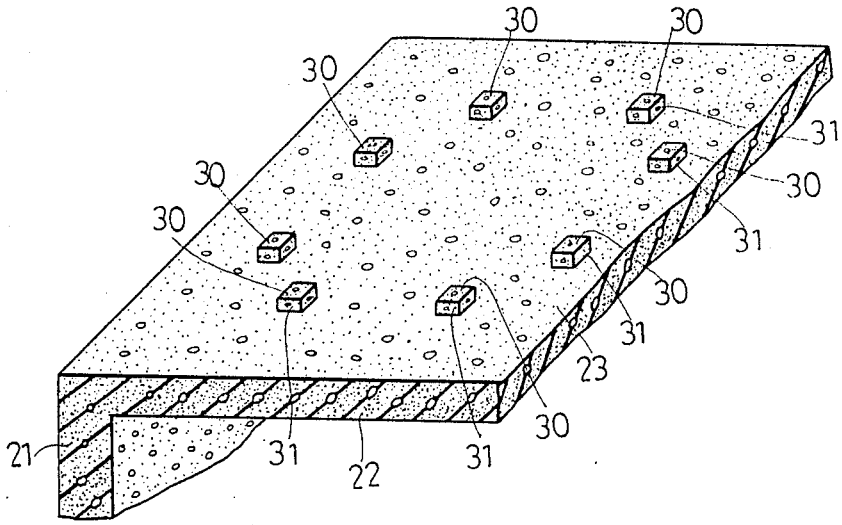
FIG. 2 is a perspective view of a construction showing a plurality of fixed supporting blocks formed integrally on the floor thereof.

Referring to FIG. 2, during the construction of the floor 22 and wall 21 of a building, a plurality of supporting blocks 30 are formed on the floor 22. Each supporting block 30 is substantially in the form of a rectangular block having at least one operation end surface 31 facing the inner steel-form mold panel to be pressed. It should be noted that the floor 22 and the wall 21 can be formed integrally to increasing the overall strength of the building. Of course, the construction of the building can be completed via a routine process by first forming the wall and subsequently the floor thereof.

Figure 4:
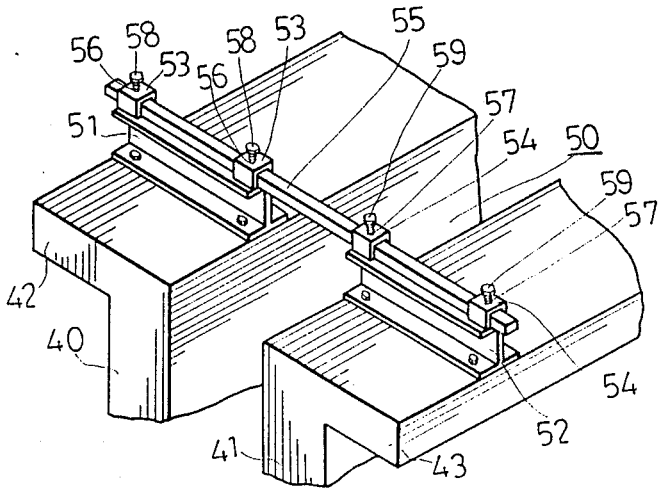
FIG. 4 is a partially enlarged perspective view of the connecting means for the steel-form mold panels.
Figure 3:
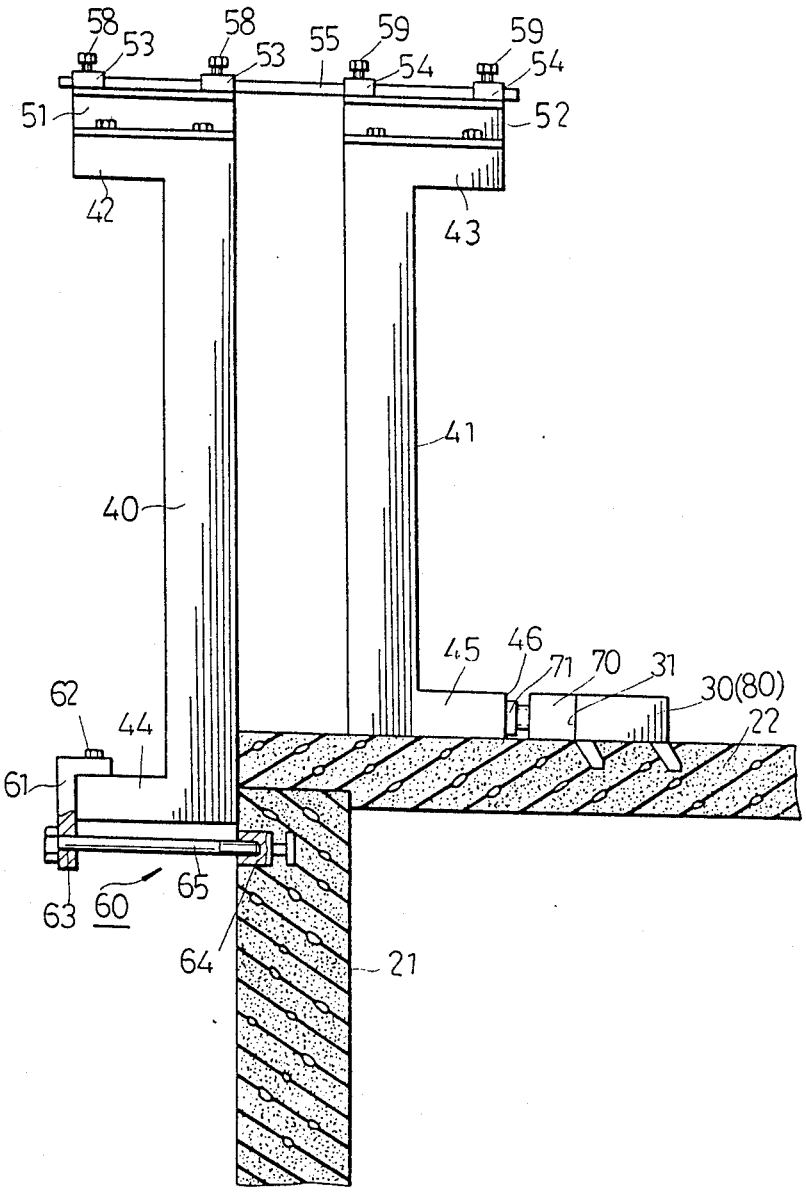
FIG. 3 is an enlarged front view of the setup of the steel-form mold panels with the inner mold panel being pressed by the supporting apparatus of the present invention.

Referring to FIGS. 3 and 4, inner and outer steel-form mold panels 41, 40 are set up with the inner mold panel being pressed by the supporting blocks 30 of the present invention. The outer and inner steel-form mold panel 40, 41 have flanges 42, 43 at the upper portions thereof respectively. A connecting apparatus 50 includes a pair of seats 51, 52 formed on the flanges 42, 43 of the mold panel, a plurality of locking members 53, 54 formed on said seats 51, 52, and a connecting rod 55 passing through said locking members 53, 54. It is readily understood that each locking member (53 or 54) is in the form of a rectangular frame with a section corresponding to the section of the connecting rod 55 so that the latter can pass through each locking member. Each of the locking members 53, 54 has a screw bore 56, 57 formed on a top side thereof with a screw 58, 59 inserted therein. It is understood that screws 58, 59 are tightened to fix the connecting rod 55 with the locking members 53, 54 after the spacing between the inner and outer steel-form mold panels has been adjusted. A plurality of sets of connecting apparatus 50 can be provided on the steel-form mold panels.

Referring again to FIG. 3, there is a flange 44 formed at the lower portion of the outer steel-form mold panel 40. A securing means 60 includes a bolt seat 64 provided in the wall 21 of the construction, a lever 61 having a first end thereof connected to the flange 44 by a bolt 62 and a second end thereof with a bore 63 formed thereon, and a bolt 65 passing through said bore 63 of the lever 61 and screwed into said bolt seat 64. This is the method in which the lower portion of the outer steel-form mold panel 40 is connected to the wall 21 of a construction.

Still referring to FIG. 3, a flange 45 is formed at the lower portion of the inner steel-form mold panel 41. The flange 45 has an end surface 46 opposing said operation end surface 31 of the supporting block 30. A jack means 70 is provided between said end surface of the flange 46, and the surface of the operation end 31. The jack means 70 can be an ordinary mechanical jack or a hydraulic cylinder having a foundation with an extendable rod 71 fixed therein. The jack means 70 is placed between the inner steel-form mold panel 41 and the supporting block 30 and then manipulated to extend the extendable rod 71 against the end surface 46 of the flange 45 of the inner steel-form mold panel 41 thereby adjusting the spacing between the inner and outer steel-form mold panels. With the arrangement shown in FIGS. 3 and 4, the outer steel-form mold panel 40 can bear a great amount of pressure due to the fact that said outer mold panel is connected to the wall 21 and the floor 22. In addition, because a plurality of supporting apparatus are provided to press the inner steel-form mold panel 41, no deformation of the same will occur during the process of concrete pouring.

Figure 5:
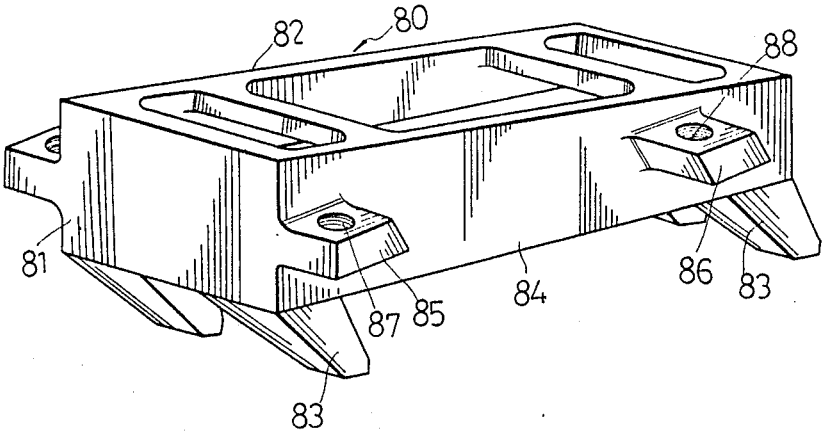
FIG. 5 is a perspective view of a supporting block having four holding pins which may be embedded into the floor of a construction.

Referring to FIG. 5, which shows a perspective of a second embodiment of the supporting block used in the apparatus, the block 80 is substantially in the form of a rectangular body 82 having an end surface 81 serving as a rest of a jack means 70 and four holding pins 83 which may be embedded in the floor 22 in a manner like that shown in FIG. 3. At the lateral sides 84 of the body 82, a pair of inclined protrusions 85, 86 are provided, each having a screw bore 87, 88 formed thereon. In consideration of the fact that normally, during construction, the supporting block 30 is not strong enough to withstand a large load in the inner mold panel as well as the fact that said block 30 is commonly be destroyed after the construction is completed, a supporting block 80 with four removable holding pins 83 is an excellent design. The supporting blocks 80 can be distributed on the floor 22 during the process of pouring the concrete floor 22. The blocks 80 will then be firmly connected on the floor 22 after the same has cured. Since the pins 83 have been designed to be inclined with respect to the floor 22, a strong structure will result which can hold a jack means 70 against the inner steel-form mold panel 41. The operation of the supporting apparatus using the supporting blocks 80 will be exactly the same as that of the supporting apparatus using the supporting blocks 30 shown in FIG. 3 and 4. This operation will not be detailed hereinbelow for the purpose of simplicity.

Figure 6:
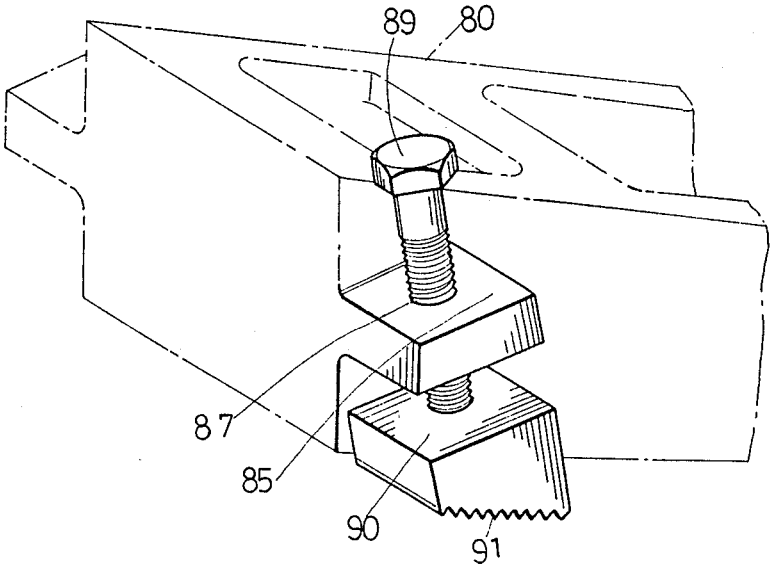
FIG. 6 is an enlarged schematic diagram illustrating how the supporting block is detached from a floor.

The supporting block 80 can be detached for re-use from the floor 22 after the construction is completed. Referring to FIG. 6, screws 89 are provided onto each of the inclined protrusions 85, 86. By rotating the screws 89, a reaction force experienced by the screws 89 when they bear against the floor 22 will cause the supporting block 80 to be pulled out from said floor 22. In order to provide an ideal contact between the screws 89 and the floor 22, a block 90 is provided with a sawtooth portion 91 in touch with the floor 22, as well as an inclined surface for the screws 89 to drive against. The supporting blocks 80 will be very easily pulled out from the floor 22 for re-use by using the screws 89 and the blocks 90.

Although the present invention has been described by way of preferred embodiments, modifications and changes are still possible for those skilled in the art without departing from the spirit of the invention.

What is claimed is:

1. An apparatus for positioning and supporting the bottom of inner mold panels which rest on a floor of a construction site where concrete wall building forms are being erected comprising:

a plurality of supporting members provided on the floor wherein each of said supporting members is substantially in the form of a body having a plurality of holding pins which may be embedded into the floor and an operational surface which faces the inner mold panel, said plurality of holding pins being inclined with respect to a planar bottom of the body; and a plurality of jack means, each said jack means being disposed between an associated supporting member serving as a rest for said jack means and the bottom of an adjacent mold panel and pressing against the bottom of said inner mold panel.

2. The apparatus as claimed in claim 1 wherein said jack means is a mechanical jack.

3. The apparatus as claimed in claim 1 wherein said jack means is a hydraulic jack.

4. The apparatus as claimed in claim 3 wherein said hydraulic jack comprises a hydraulic cylinder having a piston and a piston rod formed thereon for pressing against the inner mold panel.

5. The apparatus as claimed in claim 1 wherein said supporting member further comprises a pair of lateral side surfaces on said body, each of said surfaces having a plurality of protrusions formed thereon; each of said protrusions having a screw bore formed therein having an axis parallel to the incline direction of said holding pins and each screw bore threadedly receiving a screw therein.

6. The apparatus as claimed in claim 5 further comprising blocks having a sawtoothed portion thereof for contact on the floor and a bearing surface which contacts an end of a screw passed through said screw bore on said protrusion thereby facilitating the removal of the supporting member from the floor.

* * * * *